US008275162B2

(12) United States Patent
Bäuml et al.

(10) Patent No.: US 8,275,162 B2
(45) Date of Patent: Sep. 25, 2012

(54) METHOD FOR OPERATING A HEARING DEVICE AND MICROPHONE SYSTEM FOR HEARING DEVICE

(75) Inventors: Robert Bäuml, Eckental (DE); Jens Hain, Kleinsendelbach (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 526 days.

(21) Appl. No.: 12/434,765

(22) Filed: May 4, 2009

(65) Prior Publication Data

US 2009/0279724 A1 Nov. 12, 2009

(30) Foreign Application Priority Data

May 7, 2008 (DE) ..... 10 2008 022 533

(51) Int. Cl.
*H04R 25/00* (2006.01)
*H04R 3/00* (2006.01)

(52) U.S. Cl. ..... 381/313; 381/312; 381/92; 381/119; 381/358; 381/123

(58) Field of Classification Search ..... 381/312, 381/313, 91, 92, 316, 318, 94.1, 94.2, 94.3, 381/119, 358, 123
See application file for complete search history.

(56) References Cited

U.S. PATENT DOCUMENTS

| | | | | |
|---|---|---|---|---|
| 5,524,056 | A * | 6/1996 | Killion et al. | 381/314 |
| 6,178,248 | B1 | 1/2001 | Marash | |
| 2004/0258249 | A1* | 12/2004 | Niederdrank et al. | 381/60 |
| 2005/0025325 | A1* | 2/2005 | Fischer | 381/313 |

FOREIGN PATENT DOCUMENTS

| | | | |
|---|---|---|---|
| DE | 10327890 | A1 | 1/2005 |
| DE | 10331956 | B3 | 1/2005 |
| WO | 9740645 | A1 | 10/1997 |
| WO | WO 2007/096247 | A1 | 8/2007 |

* cited by examiner

*Primary Examiner* — Lynne Gurley
*Assistant Examiner* — Galina Yushina

(57) ABSTRACT

A method for operating a hearing device, an associated microphone system comprising at least two omnidirectional microphones, and a hearing device are provided. The microphones emit microphone signals and are electrically interconnected with one another in order to form directional characteristics. A damping of the upper frequency range of the microphone signals is determined from the lower frequency range of the microphone signals. The impression of a wideband directional microphone is produced as a result.

12 Claims, 2 Drawing Sheets

METHOD FOR OPERATING A HEARING DEVICE AND MICROPHONE SYSTEM FOR HEARING DEVICE

CROSS REFERENCE TO RELATED APPLICATIONS

This application claims priority of German application No. 10 2008 022 533.9 DE filed May 7, 2008, which is incorporated by reference herein in its entirety.

FIELD OF INVENTION

The invention relates to a method for operating a hearing device and a microphone system comprising at least two omnidirectional microphones emitting microphone signals.

BACKGROUND OF INVENTION

Speech in noise-filled environments is a frequently known problem of hearing-impaired persons, which here require a signal-to-noise ratio of one to 10 dB in order to achieve the same speech intelligibility as persons with normal hearing. Moreover the natural directional effect of the outer ear is lost in the case of coverage using behind-the-ear hearing devices. The rehabilitation using hearing devices is thus not only to include the individual compensation of the hearing loss by means of amplification and dynamic compression but also the reduction of noises, in order to bring about a significant improvement in the speech intelligibility in noisy situations. Modern digital hearing devices exhibit noise suppression methods, which satisfy the hearing device-specific requirements in terms of efficiency, sound quality and artifact freedom.

Directional microphones in this way rank among noise suppression methods which were established several years ago and clearly lead to improvements in the speech intelligibility in auditory situations, in which the wanted signal and the interference signals come from different directions. In modern hearing devices, the directional effect is generated by differential processing of two or more adjacent microphones with omnidirectional characteristics. In "Störgeräuschreduktion bei Hörsystemen der Gegenwart", [Noise reduction in present day hearing systems] Chapter "Directional microphone systems", 5th DGA Annual Convention 2002, differential $1^{st}$ and $2^{nd}$ order systems as well as systems with adaptive directional characteristics are described.

FIG. 1 shows a simplified block diagram of a 1st order directional microphone system comprising two microphones 1, 2 at a distance of approximately 10 to 15 mm. An external delay of T2 herewith occurs between the first and second microphone for acoustic signals coming from the front V, said delay corresponding to the distance of microphones 1, 2 in respect of each other for instance. The signal R2 of the second microphone 2 is delayed by the time T1 in the delay unit 3, is inverted in the inverter 4 and is added to the signal R1 of the first microphone 1 in the first adder 5. The total produces the directional microphone signal RA, which can be fed to a receiver by way of a signal processing for instance. The direction-dependent sensitivity essentially develops from a subtraction of the second microphone signal R2 delayed by time T2 from the first signal R1. Acoustic signals from the front V are thus not damped after suitable equalization, whereas acoustic signals from the rear S are deleted for instance. The design and efficiency of directional microphone systems for hearing devices are described in the patent application DE 103 31 956 B3 for instance.

SUMMARY OF INVENTION

With the increasing development of hearing devices, the useable frequency range to be processed by hearing devices also increases. Shadowings and reflections of the acoustic waves on the head of the hearing device wearer cause the directional effect of known directional microphones to reduce significantly, so that acoustically wide-band interference signals, which are actually to be deleted by the directional microphone, are only suppressed in the lower frequency range. The interference signal as a result sounds very high-pass-like. This effect compromises the subjective perception of the hearing device wearer and/or the quality of the directional microphone.

The object of the invention is to overcome this disadvantage and to specify a method for operating a hearing device as well as microphone system, which offer a subjectively improved directional effect.

According to the invention, the set object is achieved with the method and the microphone system of the independent claims.

In accordance with the invention, a method for operating a hearing device comprising at least two omnidirectional microphones is specified. The microphones emit microphone signals and are electrically interconnected with one another in order to form a directional characteristic. A damping for the upper frequency range of the microphone signals is determined from the lower frequency range of the microphone signals. This is advantageous in that wideband interference signals are effectively damped.

In one development, the interconnected microphones can emit a signal with directional characteristics and the damping can be determined from a comparison of the signal with directional characteristics and the lower frequency range of a microphone signal. A directional effect is also achieved as a result in the case of high frequencies.

In a further embodiment, the upper frequency range of a microphone signal can be exposed to damping. Furthermore, the damped upper frequency range of a microphone signal can be added to the signal with directional characteristics. This gives the impression of a wideband directional microphone.

In a further embodiment, the upper frequency range of a combination of microphone signals can be exposed to the damping.

The damped upper frequency range of the combination of microphone signals can be advantageously added to the undamped signal with directional characteristics. In special ambient situations, this may result in improved results.

Furthermore, the upper frequency range of the signal with directional characteristics can be exposed to the damping and the damped upper frequency range of the signal with directional characteristics can be added to the undamped signal with directional characteristics.

The invention also specifies a microphone system for a hearing device comprising at least a first and a second omnidirectional microphone. The microphones emit microphone signals. The microphone system includes at least one first means, which separates the microphone signals into upper and lower frequency ranges, at least one second means, which forms a microphone signal with directional characteristics from the lower frequency ranges of the microphone signals, a third means, which determines a signal damping from a comparison of the lower frequency range of the microphone signal of the first microphone with the microphone signal comprising directional characteristics, and a fourth means, which damp the upper frequency range of the microphone signal of the first microphone with the determined signal damping.

In one development, the first means may include a crossover network, the second means a directional microphone unit, the third means a damping estimation module and/or the fourth means an adjustable damping element.

In a further embodiment, the microphone system may also include a fifth means, which adds the damped upper frequency range of the microphone signal of the first microphone and the microphone signal with directional characteristics.

The fifth means can preferably include an adder.

The invention also specifies a hearing device with an inventive microphone system.

BRIEF DESCRIPTION OF THE DRAWINGS

Further details and advantages of the invention are apparent from the explanations which follow of several exemplary embodiments with reference to schematic drawings, in which.

DETAILED DESCRIPTION OF INVENTION

Figure 1:
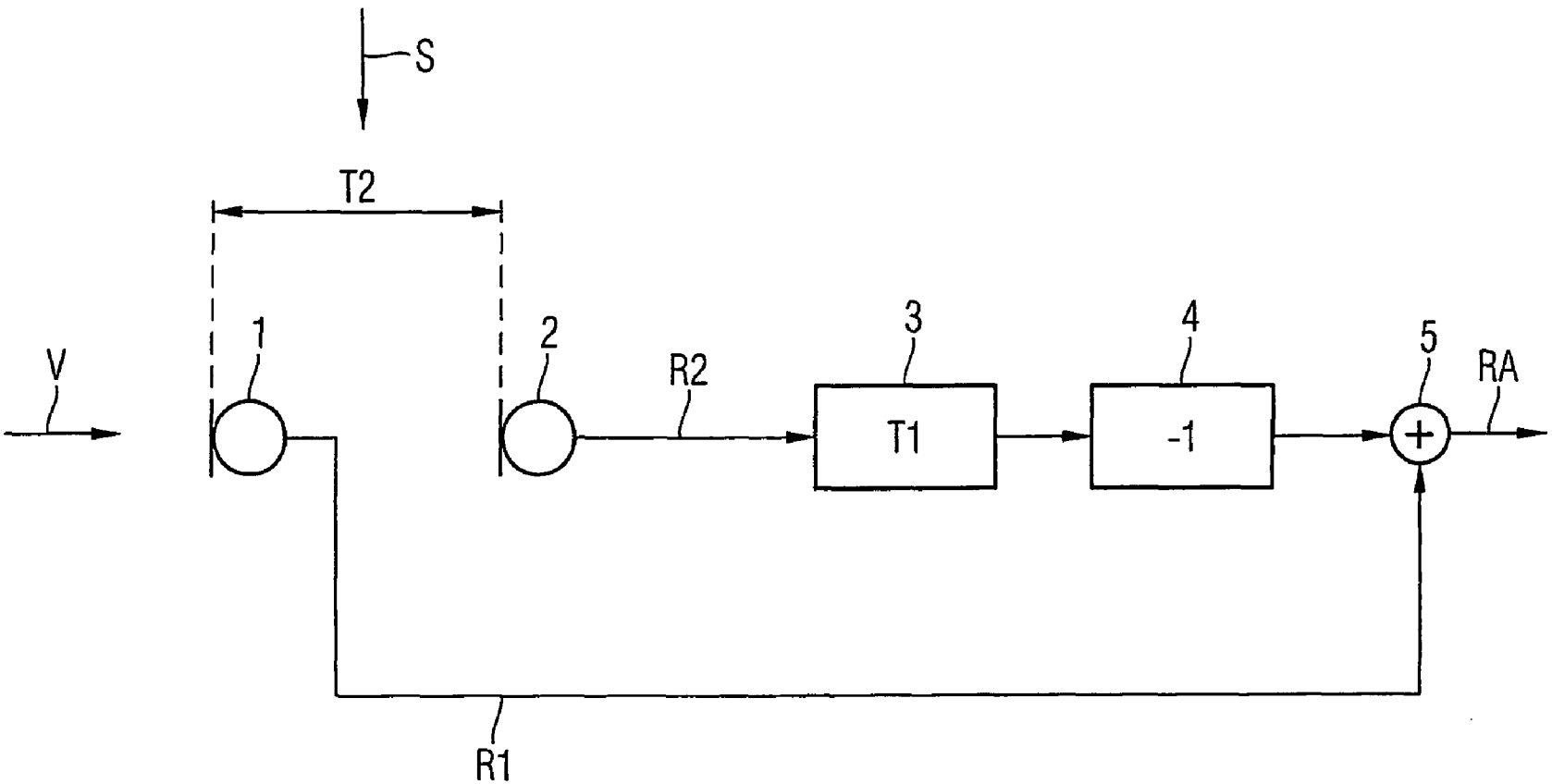
FIG 1 (Prior art)
FIG. 1: shows a block diagram of a directional microphone according to the prior art
Figure 2:
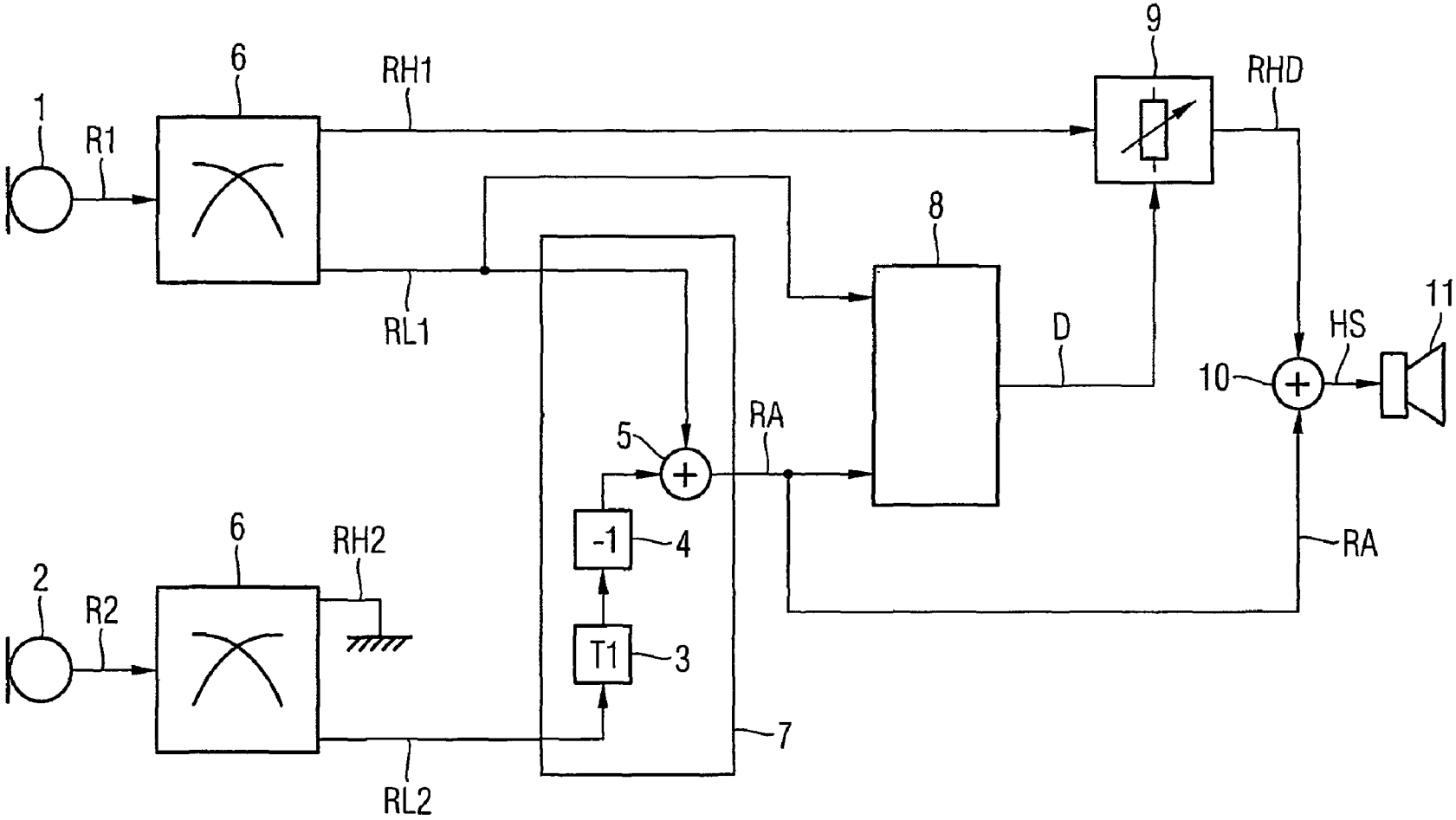
FIG. 2: shows a block diagram of an inventive microphone system.

FIG. 2 shows a basic diagram of a hearing device comprising a directional microphone system according to the invention. The microphone system includes two omnidirectional microphones 1, 2. The microphone signals R1, R2 emanating from microphones 1, 2 are respectively divided into the upper and lower frequency ranges RH1, RL1, RH2, RL2 in a crossover network 6. The upper frequency range RH1 of the first microphone signal R1 is fed to a controllable damping element 9. The lower frequency range RL2 of the second microphone signal R2 which emanates from the crossover network 6 is delayed in a delay unit 3 by the time T1, inverted by an inverter 4 and added in a first adder 5 to the lower frequency range RL1 of the first microphone signal R1. The delay unit 3, the inverter 4 and the first adder 5 together form the directional microphone unit 7. The upper frequency range RH2 of the second microphone signal R2 is discarded.

A signal RA with directional characteristics leaves the directional microphone unit 7 and is fed into an input of a damping estimation unit 8. The lower frequency range RL1 of the first microphone signal R1 is fed to a further input of the damping estimation unit 8. A damping signal D is determined in the damping estimation unit 8 by comparing the signal RA with directional characteristics and the lower frequency range RL1 of the first microphone signal R1 with the aid of an estimation algorithm. A damping signal D leaves the estimation unit 8 at an output of the damping estimation unit 8 and is fed to an input of the controllable damping element 9.

According to the value of the damping signal D, the upper frequency range RH1 of the first microphone signal R1 is damped. The upper frequency range RHD of the first microphone signal R1 corresponding to the damping signal D leaves by way of an output of the damping element 9 and is fed to an input of a second adder 10. The signal RA with directional characteristics is fed to an additional input of a second adder 10. The two signals RHD, RH are added up in a second adder 10. A total signal HS leaves the second adder 10 by way of an output. The total signal HS is either fed directly to a receiver 11 or via a digital signal processing unit (not shown).

The inventive arrangement causes the wide-band frequency range which is recorded by the microphones to be separated into a lower and upper range. The differential directional microphone operates in the lower range, while the estimated damping is applied in the upper range. The estimated damping is estimated from a comparison of the omnidirectional signal and of the signal processed by the directional microphone and is possibly modified again. The estimated damping is applied in the upper frequency range in order to generate the impression of a wideband directional microphone.

As the majority of natural signals, such as speech or music, extend from the lower frequencies to the high frequencies, an estimation for the suppression of the signals existing there can be carried out in the lower frequency range by means of the directional microphone. The estimated damping, which is to take effect in the case of high frequencies, is directionally/omnidirectionally derived significantly from the performance ratio. In addition however, expert knowledge can also be introduced by way of a corresponding characteristic curve. The estimated damping is modified further in order to avoid artifacts.

As the high frequencies barely contribute to speech intelligibility and can also be poorly differentiated by a hearing device wearer, the subjective impression develops that the directional microphone would also operate in the high frequencies. This effect is particularly noticeable in the case of a pure wanted signal from the front and a pure interference signal from the rear. Here in the case of the wanted signal, the signal is reproduced at full volume and the pure interference signal is however damped across the whole frequency range.

The invention claimed is:

1. A method for operating a hearing device, comprising:

emitting, by a first omnidirectional microphone, a first microphone signal comprising a first lower frequency range signal and a first higher frequency range signal;

emitting, by a second omnidirectional microphone, a second microphone signal comprising a second lower frequency range signal and a second higher frequency range signal;

forming a directional characteristic signal from the first and second lower frequency range signals; and determining a damping of the first higher frequency range signal from the first lower frequency range signal and the directional characteristic signal.

2. The method as claimed in claim 1, further comprising:

emitting a signal that comprises the directional characteristics and is formed from the first and second lower frequency range signals.

3. The method as claimed in claim 2, further comprising:

damping the first higher frequency range signal to form a first damped higher frequency range signal of the first microphone signal.

4. The method as claimed in claim 3, further comprising:

adding the damped first higher frequency range signal to the signal comprising directional characteristics for output.

5. The method as claimed in claim 1, further comprising:

exposing the first higher frequency range signal to a damping signal estimated from a comparison of the first lower frequency range microphone signals with a signal that comprises directional characteristics to form a damped higher frequency range signal.

6. The method as claimed in claim 5, further comprising adding the damped higher frequency range signal to the signal comprising the directional characteristics.

7. A microphone system for a hearing device, comprising:

a first omnidirectional microphone that emits a first microphone signal;

a second omnidirectional microphone that emits a second microphone signal;

a first device unit that separates the first microphone signal into a first higher frequency range signal and a first lower frequency range signal and that separates the second microphone signal into a second higher frequency range signal and a second lower frequency range signal;

a second device unit that forms from the first lower frequency range signal and the second lower frequency range signal of the first and second microphone signals, respectively, a lower frequency range directional signal that comprises directional characteristics;

a third device unit that determines a damping signal from a comparison of the first lower frequency range signal of the first microphone signal with the lower frequency range directional signal that comprises directional characteristics;

a fourth device unit that damps the first higher frequency range signal of the first microphone signal with the determined damping signal; and a fifth device unit that adds the damped first higher frequency range signal and the lower frequency range directional signal to produce a total signal output having directional characteristics in the lower frequency range and damping applied in the higher frequency range.

8. The microphone system as claimed in claim 7, wherein the first device unit includes a crossover network, wherein the second device unit includes a directional microphone unit, wherein the third device unit includes a damping estimation module, and/or wherein the fourth device includes an adjustable damping element.

9. The microphone system as claimed in claim 8, wherein the fifth device unit includes an adder.

10. A hearing device, comprising a microphone system, comprising:

a first omnidirectional microphone that emits a first microphone signal, a second omnidirectional microphone that emits a second microphone signal, a first device unit that separates the first microphone signal into a first higher frequency range signal and a first lower frequency range signal and that separates the second microphone signal into a second higher frequency range signal and a second lower frequency range signal, a second device unit that forms from the first lower frequency range signal and the second lower frequency range signal of the first and second microphone signals, respectively, a lower frequency range directional signal that comprises directional characteristics, a third device unit that determines a damping signal from a comparison of the first lower frequency range signal of the first microphone signal with the lower frequency range directional signal that comprises directional characteristics, and a fourth device unit that damps the first higher frequency range signal of the first microphone signal with the determined damping signal, and a fifth device unit that adds the damped first higher frequency range signal and the lower frequency range directional signal to produce a total signal output having directional characteristics in the lower frequency range and damping applied in the higher frequency range.

11. The hearing device as claimed in claim 10, wherein the first device unit includes a crossover network, wherein the second device unit includes a directional microphone unit, wherein the third device unit includes a damping estimation module, and/or wherein the fourth device includes an adjustable damping element.

12. The hearing device as claimed in claim 10, wherein the fifth device unit comprises an adder.

* * * * *